US006578311B2

(12) United States Patent
Danielson et al.

(10) Patent No.: US 6,578,311 B2
(45) **Date of Patent: *Jun. 17, 2003**

(54) APPARATUS AND METHOD FOR ACTUATING A WEAPON ACCESSORY BY A LASER SIGHTING BEAM

(75) Inventors: Lewis Danielson, Portland, OR (US); Joe Ouellette, Portland, OR (US)

(73) Assignee: Cremson Trace Corporation, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/194,196

(22) Filed: Jul. 12, 2002

(65) Prior Publication Data

US 2003/0029073 A1 Feb. 13, 2003

Related U.S. Application Data

(63) Continuation of application No. 09/929,222, filed on Aug. 13, 2001.

(51) Int. Cl.[7] ..... F41G 1/32; F41G 1/34; F41G 1/35

(52) U.S. Cl. ..... 42/114; 42/146; 362/110; 362/113

(58) Field of Search ..... 42/117, 111, 113, 42/146; 362/110, 113, 114

(56) References Cited

U.S. PATENT DOCUMENTS

| | | | | |
|---|---|---|---|---|
| 4,313,272 A | | 2/1982 | Matthews | |
| 4,313,273 A | | 2/1982 | Matthews et al. | |
| 5,142,805 A | * | 9/1992 | Horne et al. | 42/1.02 |
| 5,179,235 A | | 1/1993 | Toole | |
| 5,237,773 A | | 8/1993 | Claridge | |
| 5,435,091 A | | 7/1995 | Toole et al. | |
| 5,481,819 A | | 1/1996 | Teetzel | |
| 5,522,167 A | * | 6/1996 | Teetzel | 250/208.4 |
| 5,544,439 A | * | 8/1996 | Grember et al. | 42/114 |
| 5,584,137 A | | 12/1996 | Teetzel | |
| 5,618,099 A | | 4/1997 | Brubacher | |
| 5,622,000 A | | 4/1997 | Marlowe | |
| 5,628,555 A | | 5/1997 | Sharrah et al. | |
| 5,685,105 A | | 11/1997 | Teetzel | |
| 5,685,636 A | * | 11/1997 | German | 361/232 |
| 5,706,600 A | | 1/1998 | Toole et al. | |
| 5,716,216 A | | 2/1998 | O'Loughlin et al. | |
| 5,816,683 A | | 10/1998 | Christiansen | |
| 5,822,905 A | | 10/1998 | Teetzel | |
| 5,842,300 A | | 12/1998 | Cheshelski et al. | |
| 6,023,875 A | | 2/2000 | Fell et al. | |
| 6,068,484 A | | 5/2000 | O'Loughlin et al. | |

* cited by examiner

*Primary Examiner*—Charles T. Jordan
*Assistant Examiner*—John W. Zerr
(74) *Attorney, Agent, or Firm*—Birdwell, Janke & Durando, PLC

(57) ABSTRACT

A system for actuating an accessory mounted on a weapon with the sighting light beam generated by a laser sighting device. A light probe, adapted to be mounted on the weapon proximate the optical pathway of a sighting beam of light generated by a laser sighting device, is provided for detecting the sighting beam and producing in response thereto an electrical detection signal. An actuation circuit, adapted to be mounted on the weapon, is provided for receiving the detection signal and, in response thereto, actuating an electrical accessory mounted on the weapon. An ambient light sensor is provided for receiving ambient light and producing an electrical reference signal. The actuation circuit includes a comparator for comparing the detection signal to the ambient light signal and actuating a flashlight or other accessory when the detection signal passes the reference signal by a predetermined amount. The system inhibits the accessory when the ambient light passes a predetermined intensity.

16 Claims, 2 Drawing Sheets

APPARATUS AND METHOD FOR ACTUATING A WEAPON ACCESSORY BY A LASER SIGHTING BEAM

This application is a continuation of U.S. patent application Ser. No. 09/929,222, filed Aug. 13, 2001, which is incorporated herein by reference in its entirety.

BACKGROUND OF THE INVENTION

This invention relates to laser sighting devices, and particularly to the actuation of a weapon accessory, such as a flashlight removably mounted on the weapon, by the sighting beam of a laser sighting device.

Law enforcement and military organizations often find it necessary to perform armed operations in darkness or low-light conditions. To ensure that their mission is carried out properly, successfully and safely, the operational personnel often employ flashlights to illuminate a potential target in the event use of a weapon becomes necessary. It is awkward and restrictive to hold a flashlight in one hand and a weapon in the other. Consequently, flashlight attachments to weapons have been developed such that a flashlight is actually mounted on the weapon, pointing the same direction as the barrel of the weapon, so that a potential target can be illuminated by pointing the weapon generally in the direction of the target with one hand, leaving the other hand free. Ordinarily, such devices provide for the flashlight to be removably mounted on the weapon so that it does not limit weapon flexibility when it is not needed.

It is now common in law enforcement and certain military operations for weapons to be equipped with a laser sighting device, that is, a laser mounted on the weapon that propagates a relatively narrow, intense laser light beam to a target so as to produce a spot on the target essentially where the projectile will intercept the target if the weapon is discharged. This enables the weapon to be aimed precisely by pointing the weapon so that the spot lies on the target at the point where the person using the weapon wants the projectile to strike the target. Such a laser sighting device is disclosed, for example, in Toole et al. U.S. Pat. No. 5,435,091.

While a laser sighting device provides an aiming function, it does not provide an illuminating function. Consequently, it is often desirable to equip a weapon with both a laser sighting device and a flashlight attachment. Both of these types of devices require electrical power from a battery. For this and a number of other reasons, not the least of which is often a need for stealth, these devices are only actuated when they are needed. To actuate these devices, switches are required. To activate these devices with the same hand with which the weapon is gripped, one or more switches should be mounted on the weapon where the weapon is gripped, together with wiring from the switches to the accessories. In the case of a handgun, the switches should be mounted on the handgrip.

Various devices have been developed for removably mounting a flashlight on a weapon. For example, Sharrah et al. U.S. Pat. No. 5,628,555; Christiansen U.S. Pat. No. 5,816,683; and Fell et al. U.S. Pat. No. 6,023,875, all disclose devices for attachment of a flashlight to the bottom of the handgrip of a handgun. However, these devices may interfere with gripping the handgun, render holstering the handgun difficult, and require either that the flashlight be switched on, or actuated, with a hand other than the gripping hand or by a dedicated switch, separate from any switch required for a laser sighting device, disposed on the handgrip.

Other flashlight attachment devices have been designed for mounting either on the barrel of a rifle or under the barrel and frame of a handgun. In the case of a handgun, the flashlight is typically attached to a forward portion of the handgun frame by rails provided in the frame for mounting an accessory or by an adaptor for mounting the flashlight accessory. This arrangement is particularly convenient because it does not interfere with a user's hand grip and is more readily adapted for holstering. A device of this type is shown by Teetzel U.S. Pat. No. 5,685,105. In Teetzel a flashlight is removably mounted on a laser sighting device that is attached under the barrel and frame of a weapon, and the flashlight attachment may be actuated simultaneously with the laser sighting device by an infrared light source in the sighting device coupled to the flashlight attachment. However, a drawback to this approach is that a physical connection between the handgrip and the front part of the frame of the weapon is required to switch the laser and flashlight on from the handgrip. Such a connection, whether by electrical wiring, optical waveguide, or mechanical link adds weight, may require undue modification of the weapon, and may be inconvenient.

Accordingly, there is a need for a system that actuates a flashlight removably attached on or under the barrel or frame of a weapon for actuation from a handgrip without bulky and inconvenient wiring or other physical connection between a switch on the handgrip and the flashlight.

SUMMARY OF THE INVENTION

The present invention meets the aforementioned need by providing a system that employs the beam generated by a laser sighting device to actuate a flashlight mounted on or under the barrel or frame of a weapon, or some other accessory mounted on the weapon, so that operation of a switch to actuate the laser also actuates the accessory, without the need for a physical connection between a switch on the handgrip of the weapon and the accessory. A light probe, adapted to be mounted on the weapon proximate the optical pathway of a beam of light generated by a laser sighting device, is provided for detecting the beam of light and producing in response thereto a detection signal. A reference light sensor is provided for receiving ambient light and producing an ambient light signal. An actuation circuit, adapted to be mounted on the weapon, is provided for receiving the detection signal and, in response thereto, actuating an electrical accessory mounted on the weapon. The actuation circuit compares the difference between the detection signal and the ambient light signal to an actuation threshold, and actuates a flashlight or other accessory when that difference exceeds the actuation threshold. The actuation circuit also compares an ambient light signal to a deactuation threshold and inhibits actuation of the accessory when the ambient light signal exceeds that deactuation threshold.

Accordingly, it is a principal object of the present invention to provide a novel and improved system and method for actuating a weapon accessory with the sighting beam produced by a laser sighting device.

It is another object of the invention to provide a system that uses the sighting beam of a laser sighting device to actuate a flashlight assembly removably mounted on the weapon wherein the laser is mounted near the handgrip of the weapon and the flashlight assembly is mounted on or under the barrel or frame of the weapon.

It is a further object of the invention to provide a system for actuating a flashlight accessory for a weapon by the sighting beam of a laser sighting device, wherein actuation is relatively insensitive to ambient light.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
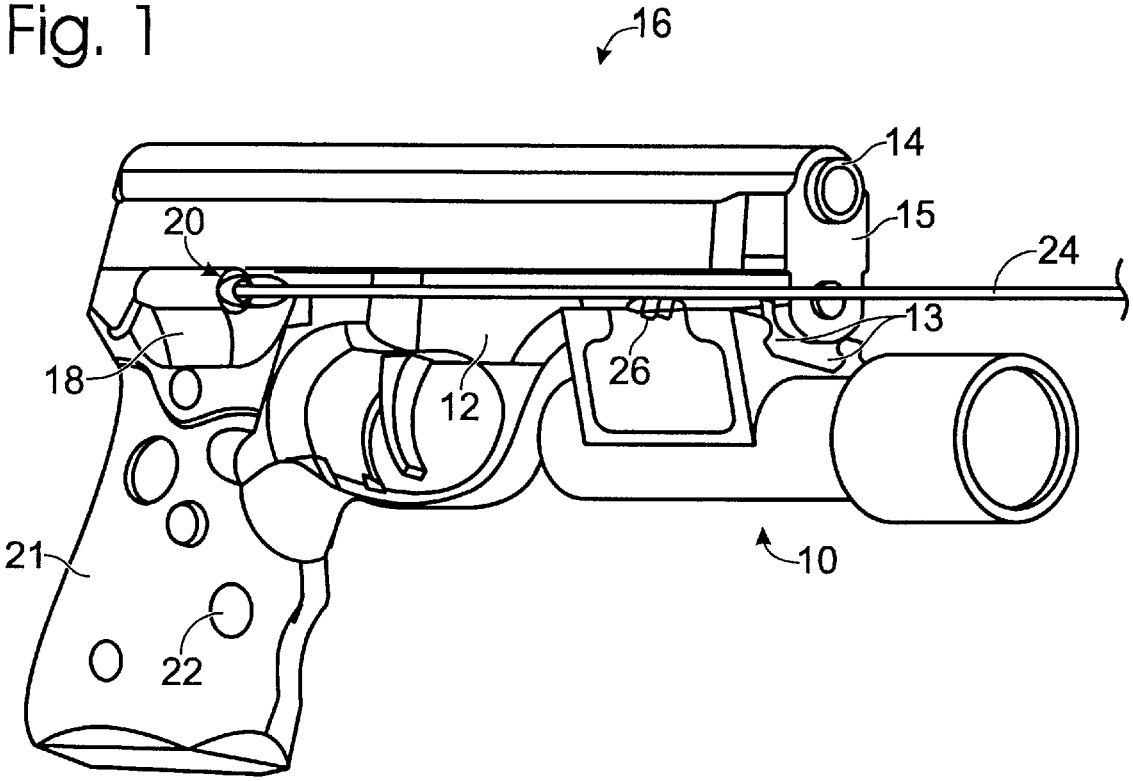
FIG. 1 is a perspective view of a weapon flashlight actuator according to the present invention, mounted on a pistol.

Referring to FIG. 1, a flashlight 10 is removably attached to the forward portion of the frame 12 of a handgun 16 beneath the barrel 14 and slide 15 of the handgun. Depending on the make and model of the handgun, the flashlight may be mounted either directly on rails 13 provided in the frame for mounting accessories, or by an appropriate adaptor. Flashlight devices of this type are commonly known in the firearms industry. Ordinarily, such flashlight attachments are actuated by a switch mounted on the attachment. In this case, the handgun 16 is equipped with a laser sighting device 18 of the type disclosed in Toole et al. U.S. Pat. No. 5,435,091, hereby incorporated by reference in its entirety. The laser 20 is mounted at the top of the handgrip 21 and is actuated by a button 22 built into the handgrip. The sighting device emits a laser beam 24 that propagates alongside the frame 12 and beyond to a potential target when the laser is turned on.

The flashlight actuator of the present invention comprises a small optical probe 26 disposed on or adjacent the flashlight attachment 10 for detecting the laser beam and producing an electrical signal indicative of the presence of that beam. Preferably, the optical probe comprises a photodetector 28, shown schematically in FIG. 2 as part of an actuation circuit 30, and an optical element for diverting a portion of the optical power of the laser beam to the photodetector 28. The actuation circuit responds to an electrical detection signal from the photodetector 28 to actuate the flashlight lamp 32.

Figure 3:
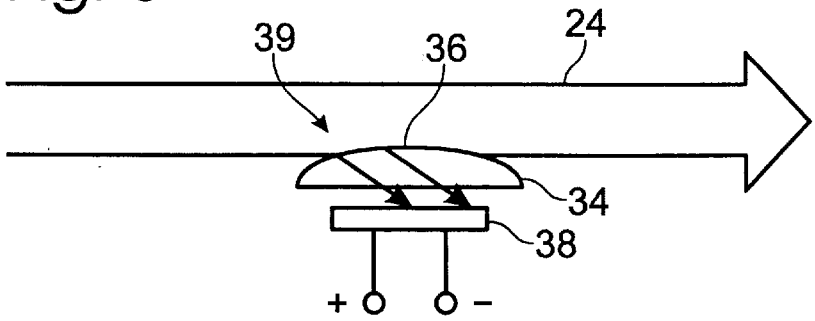
FIG. 3 is a perspective view of an exemplary optical probe for use in a weapon flashlight actuator according to the present invention.

Referring to FIG. 3, the optical element may be a single lens 34 whose front surface 36 extends into the beam of the laser and refracts some light onto a photodiode 38, or a more complicated optic, depending on how much power is needed to drive the photodiode, how much the optic affects the power and shape of the beam, and the size and shape constraints of the particular weapon installation. Typically, the lens 34 and photo diode 38 are packaged together as a photodetector. In particular, it has been found that any of a number of commonly available light emitting diodes packaged with a lens can be used as a photovoltaic detector. In this case it has also been found that by scuffing the lens slightly at position 39 more light can be directed to the diode for a given insertion of the lens into the sighting beam.

Since the photodetector 28 is exposed to ambient light as well as the laser beam 24, the system is preferably provided with a second, reference photodetector 40 which is exposed to ambient light, but not to the laser beam. Thus, the reference photodetector produces an electrical reference signal representative of the intensity of the ambient, background light. A differential amplifier 42 amplifies the difference between the detection signal and the reference signal, and produces a first actuation signal representative of the extent to which the detection signal exceeds or passes the reference signal, if at all. A first comparator 44 compares the first actuation signal to a first, adjustable reference voltage provided by potentiometer 46, which produces a second actuation signal when the first actuation signal passes the first reference voltage. (It is to be recognized that the circuit could be designed so that the detection signal produces an actuation signal either when it is or becomes positive or when it is or becomes negative with respect to the reference voltage, and the term "passes" is intended to encompass all of these possibilities.) The second actuation signal is applied to the input of a switch, in this case the gate of FET 52, which turns on the switch and allows current to flow through flashlight bulb 32. Thus, the light from the sighting beam causes the flashlight to turn on.

Figure 2:
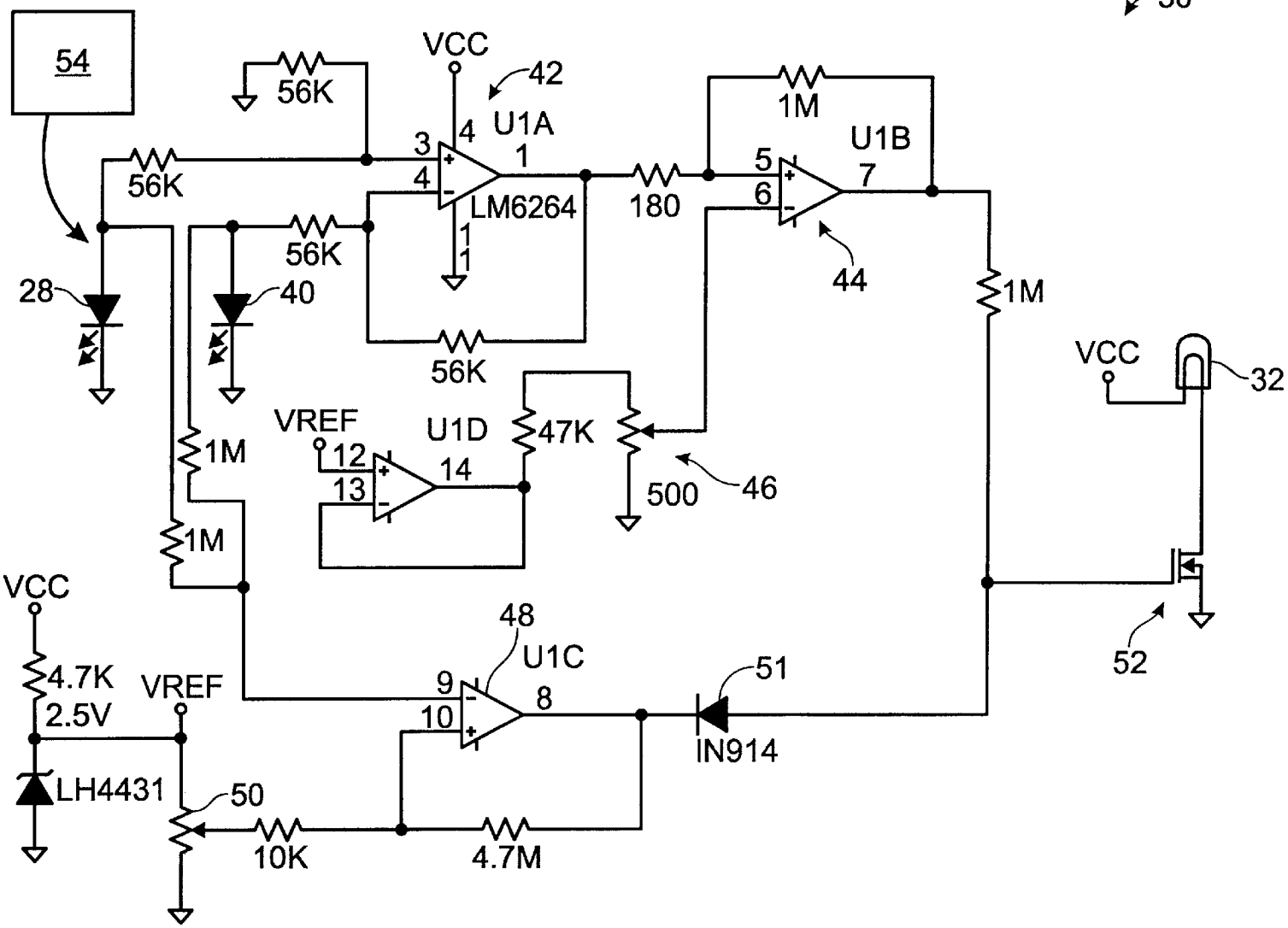
FIG. 2 is a schematic diagram of an electro-optical circuit for a weapon flashlight actuator according to the present invention.

When the ambient light is high, as would be the case, for example, in a partially lighted room, there is no need for the flashlight to be used. To prevent the flashlight from turning on in that situation, the detector signal and the reference signal are added and applied to one input of a second comparator 48, whose other input is a second reference voltage that provides a turn-off threshold based on the level of ambient light. The second reference voltage may be provided by a simple resistor voltage divider, or by a potentiometer 50, as shown in FIG. 2. If the voltage from either photodetector passes the second reference voltage, comparator 48 produces a negative turn-off signal that pulls the gate of FET 52 down, through diode 51, so as to inhibit the actuation signal and turn the FET off. This turns off the flashlight bulb 32.

Both the detection signal and the reference signal are preferably applied to the input of comparator 48 because ambient light may affect diode 28 and diode 40 slightly differently. However, essentially the same function could be provided less advantageously by only one of the photodiode. Since the power absorbed by the detection signal photodiode 28 from the sighting beam is much less than the power from ambient light required to overcome the turn-off threshold, the sighting beam will produce the second actuation signal but will not produce the turn-off signal.

In an alternative embodiment the sighting beam may be modulated by a predetermined modulation signal so as to ensure that the light actuating the attachment is produced by the sighting beam. To that end, a bandpass filter, detector and low-pass filter, or other signal discrimination element 54, may be placed in the actuation circuit 30 and coupled to photodetector 28 for providing an electrical detection signal only when the modulated sighting beam is picked up by the photodetector and detected by the actuation circuit.

The optical probe 26 and actuation circuit 30 preferably are packaged in the flashlight attachment so that when the attachment is mounted on a weapon the probe will be inserted into the laser beam only slightly and actuate the lamp when the laser beam is turned on. In this case, the lamp 32 of the flashlight would ordinarily utilize an electronic switch, as shown in FIG. 2. However, the actuator system could be an attachment to a flashlight, and the switch could also be an electro-mechanical relay, which may facilitate connection of the actuator to the flashlight. A variety of different electronic circuits could be used to actuate the flashlight lamp based on the outputs of the laser beam and the ambient light photodetectors, without departing from the principles of the invention. It is to be recognized as well that the accessory actuated by the laser beam need not necessarily be a flashlight, and that other electronic accessories mounted on a weapon might be actuated by the system described herein without departing from the principles of the invention. Further, the weapon need not be a handgun, but may be a rifle or shotgun as well.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A system for actuating by an electromagnetic signal an accessory mounted on a weapon having a handgrip and a laser sighting device, comprising:

an electromagnetic signal generator mounted adjacent the handgrip on the weapon and adapted to be actuated by a person holding the weapon by the handgrip; and an accessory adapted to be mounted on the weapon, in addition to the laser sighting device, the accessory having an electromagnetic signal receiver disposed thereon and electrically connected thereto that detects the electromagnetic signal and, in response thereto, actuates the accessory.

2. The system of claim 1, wherein said electromagnetic signal generator is adapted to be mounted on a grip of the weapon.

3. The system of claim 2, further comprising a switch adapted to be mounted on the handgrip for enabling the electromagnetic signal generator to be activated by a hand that holds the handgrip.

4. The system of claim 1, wherein the accessory is a flashlight.

5. The system of claim 1, wherein said electromagnetic signal receiver actuates the accessory when a predetermined set of conditions are present.

6. The system of claim 1, wherein the electromagnetic signal is generated by the laser sighting device.

7. The system of claim 1, wherein the accessory is a flashlight and the electromagnetic signal receiver actuates the flashlight when there is insufficient ambient light.

8. A system for actuating an accessory mounted on a weapon by an electromagnetic signal, comprising:

an electromagnetic signal generator adapted to be mounted on the weapon and actuated by a person holding the weapon;

an electromagnetic signal receiver, adapted to be mounted on the weapon for detecting the electromagnetic signal and, in response thereto, actuating an electrical accessory mounted on the weapon; and wherein the accessory is a flashlight and the electromagnetic signal receiver actuates the flashlight when there is insufficient ambient light.

9. A method for actuating by an electromagnetic signal an accessory mounted on a weapon having a handgrip and a laser sighting device, comprising:

mounting an electromagnetic signal generator on the weapon adjacent the grip;

causing the electromagnetic signal generator to generate an electromagnetic signal;

providing an accessory adapted to be mounted on the weapon, in addition to the laser sighting device, the accessory having an electromagnetic signal receiver disposed thereon and electrically connected thereto that detects the electromagnetic signal and, in response thereto, actuates the accessory;

detecting the electromagnetic signal; and actuating the accessory in response to the detection of the electromagnetic signal at the accessory.

10. The method of claim 9 wherein a person holding the weapon actuates said electromagnetic signal generator.

11. The method of claim 10 wherein the person uses a hand that holds the weapon to actuate said electromagnetic signal generator.

12. The method of claim 10, wherein the accessory is a flashlight.

13. The method of claim 10 wherein said signal is detected by an electromagnetic receiver that activates the accessory after receiving a predetermined type of signal.

14. The method of claim 10 wherein said accessory is actuated by providing current thereto.

15. The method of claim 10 further comprising modulating the electromagnetic signal by a predetermined modulation signal and, in said actuating step, actuating the accessory only in response to detection of said modulation signal.

16. A method for actuating an accessory mounted on a weapon with an electromagnetic signal, comprising:

mounting an electromagnetic signal generator on the weapon;

causing the electromagnetic signal generator to generate an electromagnetic signal;

modulating the electromagnetic signal by a predetermined modulation signal;

detecting said modulation signal; and actuating the accessory only in response to the detection of said modulation signal.

* * * * *

UNITED STATES PATENT AND TRADEMARK OFFICE

CERTIFICATE OF CORRECTION

PATENT NO. : 6,578,311 B2
DATED : June 17, 2003
INVENTOR(S) : Lewis Danielson et al.

It is certified that error appears in the above-identified patent and that said Letters Patent is hereby corrected as shown below:

Title page,
Item [73], Assignee, "Cremson" should read -- Crimson --

Signed and Sealed this

Twenty-first Day of June, 2005

JON W. DUDAS
*Director of the United States Patent and Trademark Office*